United States Patent [19]

Fiedler

[11] 4,177,091

[45] Dec. 4, 1979

[54] METHOD OF PRODUCING SILICON-IRON SHEET MATERIAL, AND PRODUCT

[75] Inventor: Howard C. Fiedler, Schenectady, N.Y.

[73] Assignee: General Electric Company, N.Y.

[21] Appl. No.: 934,194

[22] Filed: Aug. 16, 1978

[51] Int. Cl.[2] ..... H01F 1/04

[52] U.S. Cl. ..... 148/111; 148/113; 148/31.5; 148/31.55

[58] Field of Search ..... 148/111, 112, 113, 31.5, 148/31.55; 75/123 A

[56] References Cited

U.S. PATENT DOCUMENTS

| | | | |
|---|---|---|---|
| 2,867,531 | 1/1959 | Holzwarth et al. | 75/123 A |
| 3,054,732 | 9/1962 | McQuade | 148/113 |
| 3,239,332 | 3/1966 | Goss | 75/123 A |
| 3,929,522 | 12/1975 | Salsgiver et al. | 148/112 |
| 3,940,299 | 2/1976 | Goto et al. | 148/111 |
| 3,957,546 | 5/1976 | Fiedler | 148/111 |
| 4,054,470 | 10/1977 | Malagari | 148/31.55 |
| 4,096,000 | 6/1978 | Wada et al. | 148/31.5 |
| 4,096,001 | 6/1978 | Arendt et al. | 148/113 |
| 4,115,160 | 9/1978 | Benford et al. | 148/112 |
| 4,115,161 | 9/1978 | Datta | 148/112 |
| 4,123,299 | 10/1978 | Fiedler et al. | 148/113 |

*Primary Examiner*—L. Dewayne Rutledge
*Assistant Examiner*—John P. Sheehan
*Attorney, Agent, or Firm*—Leo I. MaLossi; Joseph T. Cohen

[57] ABSTRACT

The magnetic properties of silicon-iron containing tin and very low sulfur are improved without impairing weldability by adding from 0.002 to 0.010 percent selenium to the melt.

10 Claims, No Drawings

METHOD OF PRODUCING SILICON-IRON SHEET MATERIAL, AND PRODUCT

The present invention relates generally to the art of producing electrical steel and is more particularly concerned with a novel method of producing singly oriented silicon-iron sheet having both good weldability characteristics and excellent magnetic properties, and is also concerned with the resulting new product.

CROSS REFERENCE

This invention is related to the invention disclosed and claimed in U.S. patent application Ser. No. 837,505, filed Sept. 29, 1977, now U.S. Pat. No. 4,123,299, and assigned to the assignee hereof and directed to the novel concept of limiting the sulfur content in a silicon-iron melt and using tin to inhibit normal grain growth during the final anneal and thereby reducing or eliminating weld brittleness while retaining excellent magnetic properties in the resulting product.

BACKGROUND OF THE INVENTION

The sheet materials to which this invention is directed are usually referred to in the art as "electrical" silicon steels or, more properly, silicon-irons and are ordinarily composed principally of iron alloy with about 2.2 to 4.5 percent silicon and relatively minor amounts of various impurities and very small amounts of carbon. These products are of the "cube-on-edge" type, more than about 70 percent of their crystal structure being oriented in the (110) [001] texture, as described in Miller Indices terms.

Such grain-oriented silicon-iron sheet products are currently made commercially by the sequence of hot rolling, heat treating, cold rolling, heat treating, again cold rolling and then final heat treating to decarburize, desulfurize and recrystallize. Ingots are conventionally hot-worked into a strip or sheet-like configuration less than 0.150 inch in thickness, referred to as "hot-rolled band." The hot-rolled band is then cold rolled with appropriate intermediate annealing treatment to the finished sheet or strip thickness usually involving at least a 50 percent reduction in thickness, and given a final or texture-producing annealing treatment. As an alternative practice, set forth, for example, in my U.S. Pat. No. 3,957,546, assigned to the assignee hereof, the hot-rolled band is cold rolled directly to final gauge thickness.

In these boron- and nitrogen-containing silicon-irons, strong restraint to normal grain growth and thus promotion of secondary recrystallization to a precise (110) [001] grain orientation is the result of controlling the ranges of these constituents. The sulfur effective for this purpose is that which is not combined with strong sulfide-forming elements such as manganese, a presently unavoidable impurity in iron and steel. Thus, the total sulfur is necessarily greater than that necessary to provide its grain growth inhibition effect.

It is also generally recognized in the art that the presence of high total sulfur and a small quantity of boron can lead to marked brittleness in welds made in the silicon-iron alloy. Because of this weld brittleness, it has not been generally possible to weld two hot rolled coils together for cold rolling as would be a desirable operating practice since reducing the sulfur content for that purpose would have the result of degrading the magnetic properties of the metal. Having that choice usually means foregoing the advantage of good weldability.

SUMMARY OF THE INVENTION

I have discovered that in certain silicon-iron heats containing boron and nitrogen and very little sulfur grain growth inhibition can be obtained to the extent necessary for development of good magnetic properties through addition of tin and very small amounts of selenium. Further, I have found that such additions do not increase weld brittleness and that the magnetic properties are superior to those of much higher sulfur heats without tin and those of intermediate sulfur level heats to which tin but not selenium has been added. In other words, I have discovered how, through the use of tin and selenium, to produce heats having magnetic properties superior to those associated with high sulfur content and having the desirable weld characteristics associated with low sulfur content.

Specifically, I have found that the foregoing new results can be consistently achieved by adding up to 0.10 percent tin to alloys containing as little as 0.002 percent selenium, the amount of tin required being from 0.01 to 0.10 percent and generally independent of the selenium content of the heat.

Another finding that I have made is that such use of selenium enables the production of silicon-iron sheet material having superior magnetic properties without the necessity for boron in the coating applied to the decarburized sheet stock prior to the final heat treatment.

The initial hot rolling temperature can have a noticeable effect on permeability in these tin-addition silicon-iron alloys because of the importance in this respect of maximizing solution of boron nitride. Thus, for best results the hot rolling temperature should at the outset be from 1225° to 1275° C., austenite and ferrite both being stable phases in that range.

In view of these several discoveries of mine, those skilled in the art will understand that this invention has both method and product aspects. The product is a very low sulfur-content cold rolled sheet containing boron, nitrogen, tin and selenium in controlled amounts enabling development of desired magnetic properties in the finished sheet material. The process by which the sheet material is produced is likewise novel, particularly in the relation between the sulfur and tin contents.

Briefly described, in its article aspect this invention takes the form of a cold rolled silicon-iron sheet product containing 2.2 to 4.5 percent silicon and from three to 35 parts per million boron, from 30 to 75 ppm nitrogen in the above stated ratio range of boron, from 0.02 to 0.05 percent manganese, 0.002 to 0.008 percent sulfur, tin in amounts ranging from 0.01 to 0.10 percent, and from 0.002 to 0.010 percent selenium.

Similarly described, the method of this invention comprises the steps of providing a silicon-iron melt for the foregoing composition, casting the melt and hot rolling the resulting billet to produce a sheet-like body, cold rolling the hot rolled body to provide a sheet of final gauge thickness, and subjecting the resulting cold rolled sheet to a heat treatment to decarburize it and develop (110) [001] secondary recrystallization in it.

DETAILED DESCRIPTION OF THE INVENTION

In carrying out this invention, one may provide the cold-rolled sheet product described above by preparing a silicon-iron melt of the required chemistry, and then casting and hot rolling to intermediate thickness. Thus, the melt on pouring will contain from 2.2 to 4.5 percent silicon, from about three to 35 parts per million boron and about 30 to 90 ppm nitrogen in the ratio range to boron of one to 15 parts to one, manganese from 0.02 to 0.05 percent sulfur in the very low range for that element of 0.002 to 0.008 percent, and tin and selenium in the ranges stated above, the remainder being iron and small amounts of incidental impurities. Following anneal, the hot band is cold rolled with or without intermediate anneal to final gauge thickness and then decarburized.

The resulting fine-grained, primary ecrystallized, silicon-iron sheet product in whatever manner produced is provided with a magnesia or equivalent coating for the final texture-developing anneal. Preferably, the coating step is accomplished electrolytically as described in U.S. Pat. No. 3,054,732, referenced above, a uniform coating of $Mg(OH)_2$ about 0.5 mil thick thereby being applied to the sheet. Boron may be incorporated in the coating as it is formed or subsequently as disclosed and claimed in U.S. Pat. No. 4,096,001 and in my copending patent application Ser. No. 881,541, filed Feb. 27, 1978 and assigned to the assignee hereof.

As the final step of the process of this invention, the thus-coated sheet is heated in hydrogen to cause secondary grain growth which begins at about 950° C. As the temperature is raised at about 50° C. per hour to 1000° C., the recrystallization process is completed and heating may be carried on to up to 1175° C. if desired to insure complete removal of residual carbon, sulfur and nitrogen.

The following illustrative, but not limiting, examples of my novel process as actually carriedFout with the new results indicated above will further inform those skilled in the art of the nature and special utility of this invention.

EXAMPLE I

A laboratory heat was melted in an air induction furnace under an argon cover using electrolytic iron and 98 percent ferrosilicon. The heat contained 3.1 percent silicon, balance iron except for relative small amounts of elements of importance in accordance with this invention, and incidental impurities. Upon analysis, the composition of this heat in respect to said elements was as follows:

Mn: 0.035%
S: 0.003%
C: 0.037%
Sn: 0.045%
B: 4 ppm
N: 29 ppm
Se: 0.004%

A slice 1.75 inch thick was cut from an ingot cast from this melt and was hot rolled from 1250° C. in six passes to a thickness of about 100 mils. Following pickling, the hot band sample was heat treated at 950° C., the time between 930° and 950° C. being about three minutes. The hot band was then cold rolled directly to 10.8 mils final gauge thickness. Then Epstein-size strips of the cold rolled material were decarburized by heating for two minutes at 800° C. in 20° C. dew point hydrogen. The carbon level after the decarburization heat treatment is approximately 0.010 percent. This leads to higher losses but does not affect permeability. Lower carbon levels and losses may be achieved through use of an annealing atmosphere of higher dew point. The decarburized strips were brushed with milk of magnesia to a weight gain of about 40 milligrams per strip and boron additions were made to some of the magnesia coated strips using either a 0.5 percent boric acid solution or a 1.0 percent boric acid solution which deposited sufficient boron on the coating that if it were all taken up by the silicon-iron, the boron content of the metal would be increased by either 12 or 24 ppm. The resulting coated strips, including those brushed with the boric acid solutions and those not so treated, were subjected to a final anneal consisting of heating at 40° C. per hour from 800° C. to 1175° C. in dry hydrogen and holding at the latter temperature for three hours.

The magnetic properties of these annealed sheet products, particularly their permeabilities and the 60 Hertz losses at 17kB are set out in Table I together with the corresponding data gathered through the experiments described in Examples II–V below.

EXAMPLE II

In another experiment like that of Example I, a laboratory heat was melted as above described using electrolytic iron and 98 percent ferrosilicon. This heat contained 3.1 percent silicon, balance iron except for above-specified elements of importance and incidental impurities, the analysis as in Example I being as follows:

Mn: 0.035%
S: 0.004%
C: 0.039%
Sn: 0.044%
B: 10 ppm
N: 40 ppm
Se: 0.004%

The composition varied from the heat in Example I primarily in that the boron content was higher.

Processing from the melt stage to finally annealed condition was as described in Example I and the permeability values and losses measured on tests of the final sheet materials are set out in Table I.

EXAMPLE III

In a third experiment like those of Examples I and II, another heat of 3.1 percent silicon-iron was prepared having on analysis the following important element composition:

Mn: 0.035%
S: 0.004%
C: 0.040%
Sn: 0.037%
B: 8 ppm
N: 50 ppm
Se: 0.006%

Processing through the final anneal was again as set forth in Example I and the magnetic properties of the finished sheet material are stated in Table I.

EXAMPLE IV

Another experiment like the foregoing involved preparation of a 3.1 percent silicon-iron heat as described in Example I having the following analyzed composition (not including incidental impurities):

Mn: 0.036%
S: 0.004%
C: 0.037%
Sn: 0.045%
B: 5 ppm
N: 46 ppm

Se: 0.010%

Once again, processing through the final anneal was just as described in Example I. Tests of the resulting products yielded the magnetic property data appearing in Table I.

EXAMPLE V

Finally, as the last experiment in this series, a 3.1 silicon-iron heat was prepared to the following analysis as described in Example I:

Mn: 0.033%
S: 0.003%
C: 0.040%
Sn: 0.003%
B: 5 ppm
N: 31 ppm
Se: 0.009%

Processing through final anneal was as described in Example I and the magnetic property data obtained in testing the resulting products are contained in Table I.

TABLE I

MAGNETIC PROPERTIES AFTER THE FINAL ANNEAL OF THE HEATS OF EXAMPLES I–V

| | MgO | | MgO + 12ppm B | | MgO + 24ppm B | |
|---|---|---|---|---|---|---|
| | mwpp 17kB | μ10H | mwpp | μ10H | mwpp | μ10H |
| EXAMPLE I | — | 1492 | 782 | 1797 | 759 | 1820 |
| EXAMPLE II | 730 | 1869 | 652 | 1941 | 656 | 1949 |
| EXAMPLE III | 716 | 1912 | 713 | 1914 | 689 | 1924 |
| EXAMPLE IV | 651 | 1926 | 644 | 1936 | 641 | 1933 |
| EXAMPLE V | 1222 | 1501 | 898 | 1770 | 893 | 1768 |

The beneficial effect of selenium content in heats containing tin but with very low sulfur is evident in Table I, particularly the heats of Examples II, III and IV. That tin is beneficial in heats containing selenium is apparent from the data stated for the heats of Examples IV and V.

In addition to exhibiting superior magnetic properties, the Example II heat developed no cracks during the standard laboratory welding test described in detail in my copending patent application Ser. No. 837,505 referenced above. This test exaggerates any tendency for crack development during welding.

What I claim as new and desire to secure by Letters Patent of the United States is:

1. The method of producing grain oriented silicon-iron sheet having superior magnetic properties and good weld characteristics which comprises the steps of providing a silicon-iron melt containing 2.2 to 4.5 percent silicon, between about three and 35 parts per million boron, between about 30 and 75 parts per million nitrogen in the ratio to boron of one to 15 parts per part of boron, from 0.02 to 0.05 percent manganese, less than 0.010 percent sulfur, tin in amounts ranging from 0.01 to 0.10 percent, and from 0.002 to 0.010 percent selenium, casting the melt and hot rolling the resulting billet to form an elongated sheet-like body, cold rolling the hot rolled body to provide a sheet of final gauge thickness, and subjecting the resulting cold-rolled sheet to a final heat treatment to decarburize it and to develope (110) [001] secondary recrystallization texture in it.

2. The method of claim 1 in which the manganese content of the melt is about 0.035 percent, the sulfur content of the melt is about 0.004 percent, the tin content of the melt is about 0.045 percent and the selenium content of the melt is about 0.010 percent, and in which the billet is hot rolled from about 1225° C. to 1275° C.

3. The method of claim 1 in which the melt contains about 0.035 percent manganese, about 0.004 percent sulfur, about 0.037 percent tin and about 0.006 percent selenium.

4. The method of claim 1 in which the melt contains between about 0.035 percent manganese, about 0.004 percent sulfur, about 0.045 percent tin and about 0.004 percent selenium.

5. The method of claim 2 in which in preparation for the final heat treatment step the cold-rolled silicon-iron sheet is provided with an electrically-insulating adherent coating containing from about 12 to about 36 parts per million boron on the basis of the said silicon-iron sheet.

6. The method of claim 4 in which in preparation for the final heat treatment step the cold-rolled silicon-iron sheet is provided with an electrically-insulating adherent coating containing from about 12 to about 36 parts per million boron on the basis of the said silicon-iron sheet.

7. A cold-rolled sheet for processing into singly oriented silicon-iron having a permeability of at least 1900 gauss at 10 oersteds and a core loss of no more than 0.700 watt per pound at 17 kilogauss, said sheet containing 2.2 to 4.5 percent silicon, between about three and 35 parts per million boron, between about 30 and 75 parts per million nitrogen in the ratio to boron of one to 15 parts per part of boron, from 0.02 to 0.05 percent manganese, less than about 0.004 percent sulfur, from 0.01 to 0.10 percent tin and from about 0.002 to 0.010 percent selenium, and said sheet having good weld characteristics.

8. The cold-rolled sheet of claim 7 in which the manganese content is about 0.035 percent, the sulfur content is less than about 0.004 percent, the tin content is about 0.045 percent and the selenium content is about 0.010 percent.

9. The cold-rolled sheet of claim 7 in which the selenium content is about 0.004 percent.

10. The method of claim 1 in which in preparation for the final heat treatment step the cold rolled silicon-iron sheet is provided with an electrically-insulating adherent coating containing between about 10 and 50 parts per million boron on the basis of said silicon-iron sheet.

* * * * *